US009349362B2

(12) United States Patent
Hennig

(10) Patent No.: US 9,349,362 B2
(45) Date of Patent: May 24, 2016

(54) METHOD AND DEVICE FOR INTRODUCING HUMAN INTERACTIONS IN AUDIO SEQUENCES

(71) Applicant: Holger Hennig, Cambridge, MA (US)

(72) Inventor: Holger Hennig, Cambridge, MA (US)

( * ) Notice: Subject to any disclaimer, the term of this patent is extended or adjusted under 35 U.S.C. 154(b) by 0 days.

(21) Appl. No.: 14/304,014

(22) Filed: Jun. 13, 2014

(65) Prior Publication Data

US 2015/0364123 A1 Dec. 17, 2015

(51) Int. Cl.
*G10H 7/00* (2006.01)
*G10H 1/40* (2006.01)

(52) U.S. Cl.
CPC . *G10H 7/00* (2013.01); *G10H 1/40* (2013.01); *G10H 2210/031* (2013.01); *G10H 2210/115* (2013.01); *G10H 2210/356* (2013.01)

(58) Field of Classification Search
CPC ..... G10H 7/00; G10H 2210/031
USPC ..... 84/609, 611
See application file for complete search history.

(56) References Cited

U.S. PATENT DOCUMENTS 3,974,729 A * 8/1976 Koike ..... G10H 1/40 84/667
5,357,048 A * 10/1994 Sgroi ..... G10H 1/0066 84/622
6,066,793 A * 5/2000 Ogai ..... G10H 1/02 84/615
6,506,969 B1 * 1/2003 Baron ..... G10H 1/0025 84/609
7,777,123 B2 8/2010 Hennig
8,987,574 B2 * 3/2015 Matusiak ..... G10H 1/0025 84/609
2002/0184505 A1 * 12/2002 Mihcak ..... G06F 17/30026 713/180
2007/0074620 A1 * 4/2007 Kay ..... G10H 1/00 84/619
2008/0156178 A1 * 7/2008 Georges ..... G10H 1/0025 84/645
2009/0084250 A1 * 4/2009 Hennig ..... G10H 1/40 84/609

OTHER PUBLICATIONS

Hennig ("The Nature and Perception of Fluctuations in Human Musical Rhythms" PLoS ONE 6, e264572011).*
Delignieres et al. ("Strong anticipation and long-range cross-correlation: Application of detrended cross-correlation analysis to human behavioral data" Jan. 15, 2014; viewed online at http://www.sciencedirect.com/science/article/pii/S037843711300914X.*
Podobnik, et al. "Time-lag cross-correlations in collective phenomena," Exploring the Frontiers of Physics (EPL), 90 (Jun. 2010) 68001.
Podobnik, et al. "Quantifying cross-correlations using local and global detrending approaches," Eur. Phys. J. B 71, 243-250 (2009).
Podobnik, et al, "Modeling long-range cross-correlations in two-component ARFIMA and FIARCH processes," Physica A 387 (Jan. 2008) 3954-3959.
Podobnik, et al. "Detrended Cross-Correlation Analysis: A New Method for Analyzing Two Nonstationary Time Series," Physical Review Letters 100, 084102 (Feb. 2008).
Hennig, H. "Synchronization in human musical rhythms and mutually interacting complex systems," submitted to Proceedings of the National Academy of Sciences of the United States of America.

(Continued)

*Primary Examiner* — David Warren
(74) *Attorney, Agent, or Firm* — Siritzky Law, PLLC

(57) ABSTRACT

A method for combining first second audio tracks includes modifying at least one of the two audio tracks; and storing the first and the second audio track in a non-volatile medium, characterized in that the interbeat intervals of the modified first and the second audio track exhibit long-range cross-correlations (LRCC).

10 Claims, 3 Drawing Sheets

(56) References Cited

OTHER PUBLICATIONS

Hennig, et al. "Musical rhythms: The science of being slightly off," Physics Today 65, 64-65 (Jul. 2012).
Gilden et al. "1/f Noise in Human Cognition," Science, New Series, vol. 267, No. 5205 (Mar. 24, 1995), 1837-1839.
Hennig H, et al. "The Nature and Perception of Fluctuations in Human Musical Rhythms," PLoS ONE 6(10), Oct. 2011.
Repp, BH, Su YH (Feb. 2013), Sensorimotor synchronization: A review of recent research, (2006-2012). Psychon B Rev 20:403-452.

* cited by examiner

Figure 5
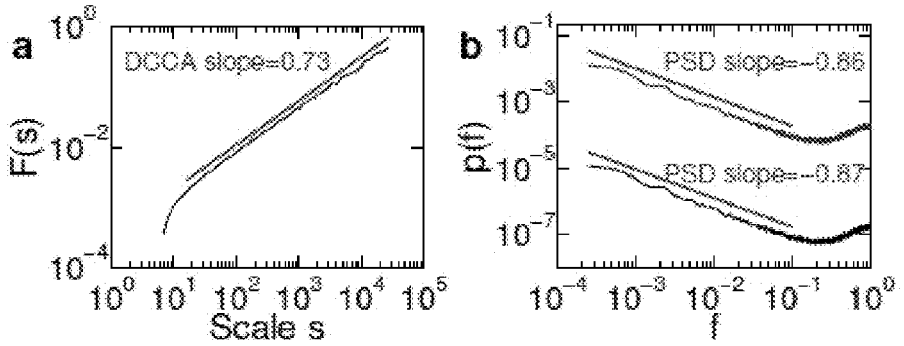
Figure 6
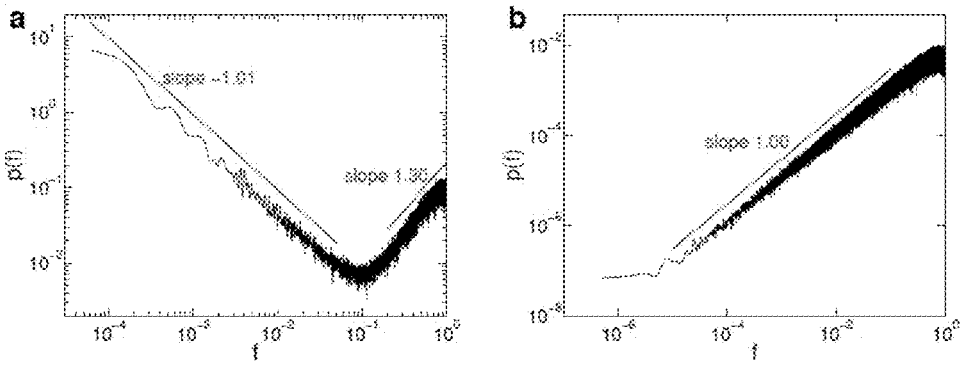
Figure 7
700
MUSICAL COUPLING BETWEEN TRACKS
| Channel | Timing Error Standard Deviation | Timing Error Spectrum (beta) | Motor Error Standard Deviation | Coupling strength W | Offset |
|---|---|---|---|---|---|
| 1 | 3.00 ms | 1.00 | 5.00 ms | 0.5 | 7.24 ms |
| 2 | 4.00 ms | 0.90 | 1.00 ms | 0.5 | - 2.33 ms |
| 3 | | | | | |
| 4 | | | | | |

METHOD AND DEVICE FOR INTRODUCING HUMAN INTERACTIONS IN AUDIO SEQUENCES

The present invention relates to a method and device for introducing human interactions in audio sequences.

Post-processing has become an integral part of professional music production. A song, e.g. a pop or rock song or a film score is typically assembled from a multitude of different audio tracks representing musical instruments, vocals or a software instruments. In audio engineering, tracks are often combined where musicians have not actually played together. This may eventually be recognized by a listener.

It is therefore an object of the present invention to provide a method and a device for combining audio tracks, where the result sounds like a simultaneous recording of the individual tracks, even if they were recorded separately.

SUMMARY OF THE INVENTION

This object is achieved by a method and a device according to the independent claims. Advantageous embodiments are defined in the dependent claims.

According to the invention, determining these characteristics of scale-free (fractal) musical coupling in human play can be used to imitate the generic interaction between two musicians in arbitrary audio tracks, comprising, in particular, electronically generated rhythms.

More particularly, the interbeat intervals exhibit long-range correlations (LRC) when one or more audio tracks are modified and the interbeat intervals exhibit long-range cross-correlations (LRCC) when two or more audio tracks are modified.

A time series contains LRC if its power spectral density (PSD) asymptotically decays in a power law, $p(f) \sim 1/f^{\beta}$ for small frequencies f and $0<\beta<2$. The limits $\beta=0$ ($\beta=2$) indicate white noise (Brownian motion) while $-2<\beta<0$ indicates anti-correlations. In the literature, different normalizations for the power spectral frequency f can be found, which can be converted into one another. Here, f is measured in units of the Nyquist frequency ($f_{Nyquist}=½$ Hz), which is half the sampling rate of the time series.

Long-Range Cross-Correlations (LRCC) between two sequences of interbeat intervals, i.e. two non-stationary time series, exist if the covariance $F_{DCCA}(s)$ defined below asymptotically follows a power law $F(s) \sim s^{\delta}$ with $0.5<\delta<1.5$. In contrast, $\delta=0.5$ indicates absence of LRCC.

The presence of such cross-correlations may be measured using a variant of detrended cross-correlation analysis (DCCA) [Podobnik B, Stanley H (2008), Detrended Cross-Correlation Analysis: A New Method for Analyzing Two Nonstationary Time Series. Phys. Rev. Lett. 100:084102]. Global detrending with a polynomial of degree k may be added as an initial step prior to DCCA, which has been shown crucial in analyzing slowly varying non-stationary signals [Podobnik B, et al. (2009), Quantifying cross-correlations using local and global detrending approaches. Eur. Phys. J. B 71:243-250.]. In fact, global detrending proved to be a crucial step to calculate the DCCA exponent of the non-stationary time series of interbeat intervals analyzed by the inventors. Without global detrending much larger DCCA exponents are obtained, i.e., spurious LRCC are detected that reflect global trends.

Given two time series $X_n$, $X_n'$, where n=1 . . . N, the DCCA method including prior global detrending thus consists of the following steps:

(1) Global detrending: fitting a polynomial of degree k to $X_n$ and a polynomial to $X_n'$, where typically k=1 . . . 5. One may use k=3. It should carefully be checked that the obtained DCCA scaling exponents do not change significantly with k.

(2) Integrating the time series $R_n=\Sigma_{i=1}^{n} X_n$ and $R_n'=\Sigma_{i=1}^{n} X_n'$.

(3) Dividing the series into windows of size s, (3) Least-squares fit $\tilde{R}_n$ and $\tilde{R}_n'$ for both time series in each window.

(4) Calculating the detrended covariance $$F_{DCCA}(s) = 1/(N_s-1)\sum_{k=1}^{N_s}(R_k-\tilde{R}_k)(R_k'-\tilde{R}_k'),$$

where $N_s$ is the number of windows of size s.

For fractal scaling, $F_{DCCA}(s) \alpha s^{\delta}$ with $0.5<\delta<1.5$. Absence of LRCC are indicated by $\delta=0.5$. Another indicator of absence of LRCC is that the detrended covariance $F_{DCCA}(s)$ changes signs and fluctuates around zero as a function of the time scale s [Podobnik B, et al. (2009), Quantifying cross-correlations using local and global detrending approaches, Eur. Phys. J. B 71:243-250].

The invention may be embodied in a computer-implemented method or a device for combining a first and a second audio track, in a software plugin product, e.g. for a digital audio workstation (DAW) that, when executed, implements a method according to the invention, in an audio signal, comprising one or more audio tracks obtained by a method according to the invention and/or in a medium storing an audio signal according to the invention.

BRIEF DESCRIPTION OF THE FIGURES

These and other aspects and advantages of the present invention are described more thoroughly in the following detailed description of embodiments of the invention and with reference to the drawing in which

FIG. 5 shows: (a) Evidence of scale-free cross-correlations in the MICS model (b)

FIG. 6 shows an illustration of the PSD of the interbeat intervals when humans are playing or synchronizing rhythms (a) without and (b) with a metronome.

FIG. 7 shows a user interface 700 of a software implemented human interaction device based on the MICS model.

DETAILED DESCRIPTION

Figure 1:
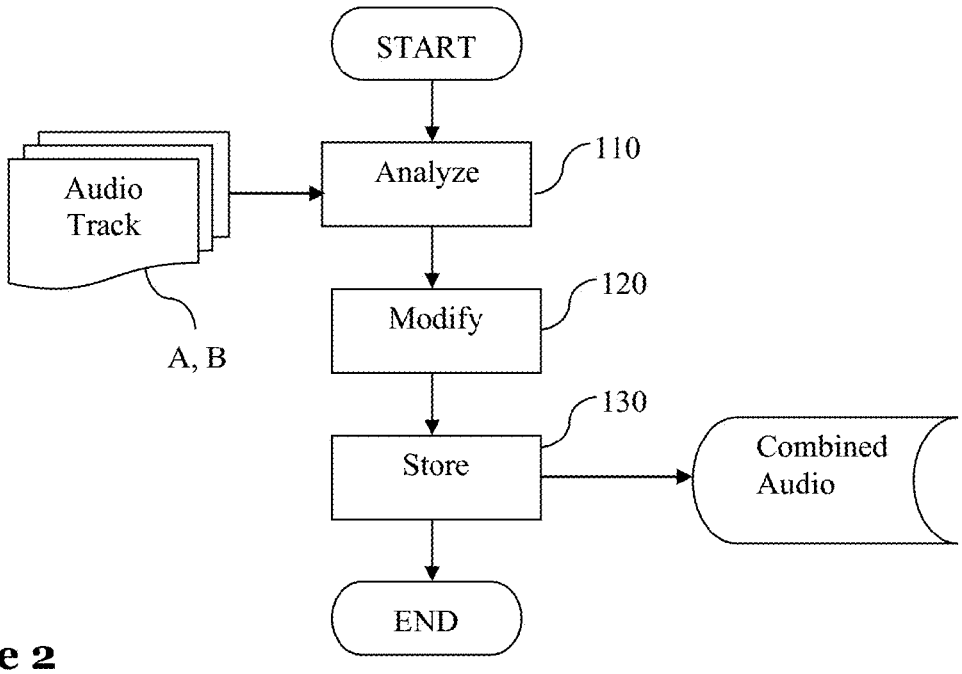
FIG. 1 shows a flowchart of a method according to an embodiment of the invention.

FIG. 1 shows a flowchart of a method according to an embodiment of the invention. The method receives a first audio track A and a second audio track B as inputs.

The procedure to introduce human-like musical coupling in two audio tracks A and B is demonstrated using an instrumental version of the song 'Billie Jean' by Michael Jackson. The song Billie Jean was chosen because drum and bass tracks consist of a simple rhythmic and melodic pattern that is repeated continuously throughout the entire song. This leads to a steady beat in drum and bass, which is well suited to demonstrate their generic mutual interaction. For simplicity, all instruments were merged into two tracks: track A includes all drum and keyboard sounds, while track B includes the bass.

In step 110, the interbeat intervals of the first and the second audio track are determined. The interbeat intervals of tracks A and B read $I_{A,t}=X_t+T$ and $I_{B,t}=Y_t+T$, where T is the average interbeat interval given by the tempo (here, T=256 ms, which corresponds to 234 beats per minute in the eighth notes). In case the audio tracks are MIDI files, this may be done based on the 'note on' messages. In other case, known suitable beat detection procedures may be used.

If the time series $X_t$ and $Y_t$ are long-range cross-correlated, a musical coupling between drum and bass tracks is obtained.

In step 120, the interbeat intervals of at least one of the first audio track A and the second audio track B are modified. Small deviations are added to the interbeat intervals in order to modify a long-range cross-correlation (LRCC) between the interbeat intervals of the first and the second audio track. More particularly, the interbeat intervals are modified in order to induce LRCC between the interbeat intervals of the two audio tracks with a power law exponent, also called DCCA exponent δ, which measures the strength of the LRCC. For δ=0.5, there are no LRCC, while the strength of the LRCC increases with δ.

More than two audio tracks can be modified by having each additional track responding to the average of all other tracks' deviations.

In particular, musical coupling between $X_t$ and $Y_t$ is introduced using a two-component Autoregressive Fractionally Integrated Moving Average (ARFIMA) process with δ=0.9, (2), that generates two time series $x_{1,2}$ which exhibit LRCC [Podobnik B, Stanley H (2008), Detrended Cross-Correlation Analysis: A New Method for Analyzing Two Nonstationary Time Series. Phys. Rev. Lett. 100:084102; Podobnik B, Wang D, Horvatić D, Grosse I, Stanley H E (2010), Time-lag cross-correlations in collective phenomena, Europhys. Lett. 90:68001].

The process is defined by $$X_t = \sum_{n=1}^{\infty} w_n(\alpha_A - 0.5)x_{t-n}$$

$$Y_t = \sum_{n=1}^{\infty} w_n(\alpha_B - 0.5)y_{t-n}$$

$$x_t = [WX_t + (1-W)Y_t] + \xi_{t,A}$$

$$y_t = [(1-W)X_t + WY_t] + \xi_{t,B}$$

with Hurst exponents $0.5<\alpha_{A,B}<1$, weights $w_n(d)=d\,\Gamma(n-d)/(\Gamma(1-d)\,\Gamma(n+1))$, Gaussian white noise $\xi_{t,A}$ and $\xi_{t,B}$ and gamma function Γ. The coupling constant W ranges from 0.5 (maximum coupling between $x_t$ and $y_t$) to 1 (no coupling). It has been shown analytically, that the cross-correlation exponent is given by $\delta=(\alpha_A+\alpha_B)/2$.

Figure 2:
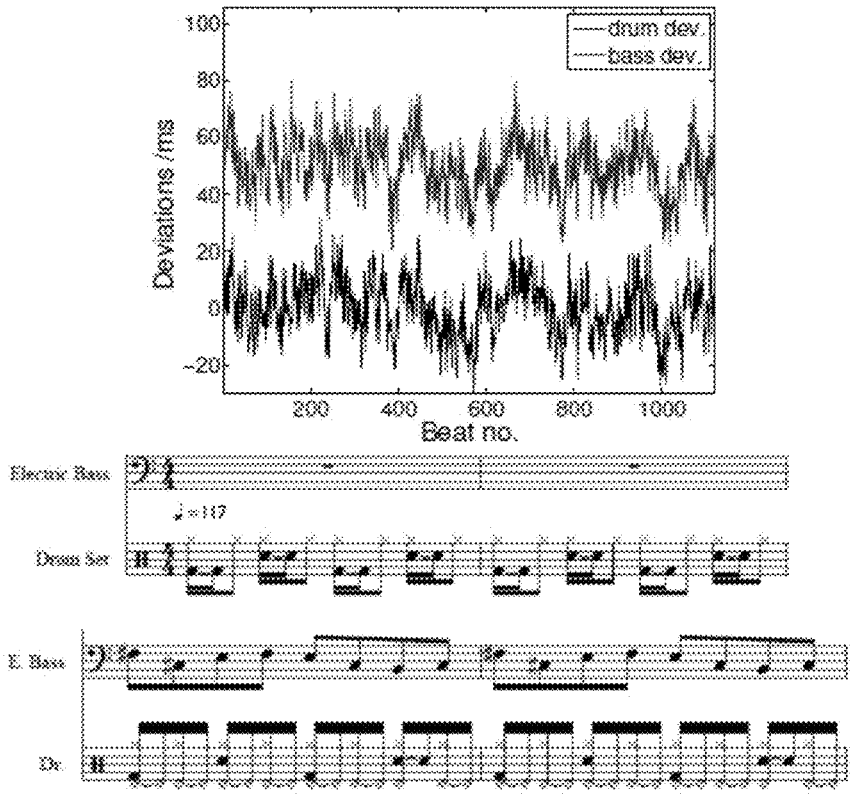
FIG. 2 shows an example of two coupled time series generated with the two-component ARFIMA process.

The standard deviation chosen for $X_t$ and $Y_t$ was 10 ms. The time series of deviations $X_t$ and $Y_t$ for musical coupling are shown in FIG. 2. The measured DCCA exponent reads δ=0.93 (in agreement with the analytical value 0.9 within margins of error) showing LRCC.

Introducing LRC in audio tracks is referred to as "humanizing". For separately humanized sequences (i.e., without adding cross-correlations between the sequences), however, absence of LRCC is expectable. Indeed, when humanizing the time series of interbeat intervals separately (e.g., with an exponent β=0.9), the detrended covariance of $X_t$ and $Y_t$ oscillates around zero, i.e., no LRCC are found.

All other characteristics, such as pitch, timbre and loudness remain unchanged.

In step 130, the combined audio tracks are stored in a non-volatile, computer-readable medium.

FIG. 2 shows an example of two coupled time series generated with the two-component ARFIMA process. The deviations from their respective positions (e.g., given by a metronome) are shown in the drum track (upper blue curve, offset by 50 ms for clarity) and bass track (lower black curve) to introduce musical coupling. When an instrument is silent on a beat, the corresponding deviation is skipped. The time series each of length N=1120 were generated with a two-component ARFIMA process with Hurst exponents $\alpha_A=\alpha_B=0.9$ and coupling constant W=0.5. The bottom of FIG. 2 shows an excerpt of the first four bars of the song Billie Jean by Michael Jackson. Because there is a drum sound on every beat, all 1120 deviations are added to the drum track, whereas in the first two bars the bass pauses.

Other processes than the ARFIMA process that generate LRCC can also be used to induce musical coupling. More particularly, when two subjects A and B are synchronizing a rhythm, each person attempts to (partly) compensate for the deviations $d_n=t_{A,n}=t_{B,n}$ perceived between the two n'th beats when generating the n+1'th beat. This is reflected by the following model referred to as the Mutually Interacting Complex Systems (MICS) model $$I_{A,n}=\sigma_A C_{A,n}+T+\xi_{A,n}-\xi_{A,n-1}-W_A d_{n-1}$$

$$I_{B,n}=\sigma_B C_{B,n}+T+\xi_{B,n}-\xi_{B,n-1}+W_B d_{n-1} \quad (1)$$

where $C_{A,n}$ and $C_{B,n}$ are Gaussian distributed $1/f^{\beta}$ noise time series with exponents $0<\beta_{A,B}<2$, $\xi_{A,n}$ and $\xi_{B,n}$ is Gaussian white noise and T is the mean beat interval. We set $d_0=0$. The model assumes that the generation of temporal intervals is composed of three parts: (i) an internal clock with $1/f^{\beta}$ noise errors, (ii) a motor program with white noise errors associated with moving a finger or limb, referred to in FIG. 7 as the motor error, (iii) an coupling term between the subjects with coupling strengths $W_A$ and $W_B$.

The deviations $d_n$ which the musicians perceive and adapt to can be written as a sum over all previous interbeat intervals $$d_n = t_{A,n} - t_{B,n} = \sum_{j=1}^{n} (I_{A,j} - I_{B,j})$$

thus involving all previous elements of the time series of IBIs of both musicians. Therefore, this model reflects that scale-free coupling of the two subjects emerges mainly through the adaptation to deviations between their beats.

The coupling strengths $o<W_{A,B}<2$ describe the rate of compensation of a deviation in the generation of the next beat. In the limit $W_A=W_B=0$ and $\beta_A=\beta_B=1$ the second model reduces to the model introduced by Gilden et al., in the following called the Gilden model [Gilden D L, Thornton T, Mallon M W (1995), 1/f noise in human cognition, Science 267:1837-1839]. The MICS model diverges for $W_A+W_B\geq 2$, i.e., when subjects are over-compensating.

A possible extension of the second model is to consider variable coupling strengths $W=W(d_n)$. Since larger deviations are likely to be perceived more distinctly, one possible scenario is to introduce couplings W that increase with $d_n$. For example, W may increase when large deviations such as glitches are perceived.

Figure 3:
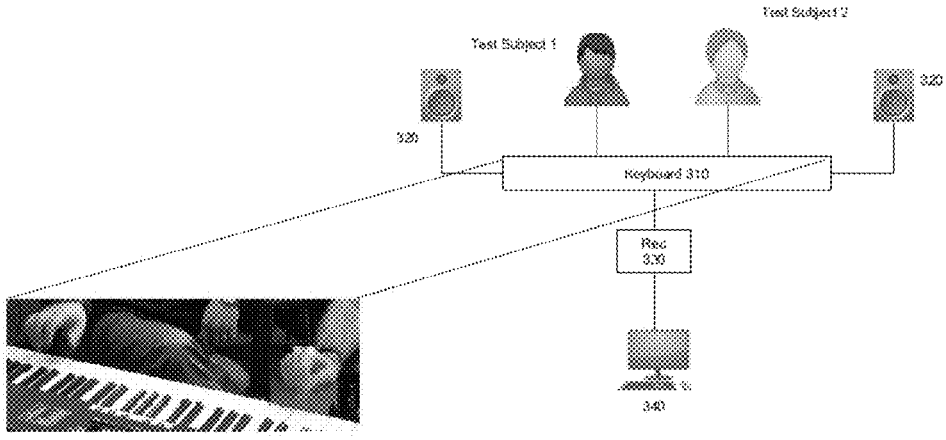
FIG. 3 shows a diagram of an experimental setup for analyzing combinations of audio tracks played by a human subject.

FIG. 3 shows a diagram of an experimental setup for analyzing combinations of audio tracks played by a human subject.

The experimental setup comprises a keyboard 310 connected to speakers 320 and a recorder 330 for recording notes played by test subjects 1 and 2 on the keyboard 310. Preferably, the keyboard 310 has a midi interface and the recording device 330 records midi messages.

The performances were recorded at the Harvard University Studio for Electroacoustic Composition (See Supporting Information for details) on a Studiologic SL 88o keyboard yielding 57 time series of Musical Instrument Digital Interface (MIDI) recordings. However, the results presented here apply not only to MIDI but also to acoustic recordings.

Each recording typically lasted 6-8 minutes and contained approx. 1000 beats per subject. The temporal occurrences $t_1, \ldots, t_n$ of the beats were extracted from the MIDI recordings and the interbeat intervals read $I_n=t_1 \ldots t_{n-1}$ with $t_0=0$. The subjects were asked to press a key with their index finger according to the following. Task type (Ia): Two subjects played beats in synchrony with one finger each. (Ib) 'Sequential recordings' were made, where subject B synchronized with prior recorded beats of subject A. Sequential recordings are widely used in professional studio recordings, where typically the drummer is recorded first, followed by layers of other instruments. Task type (II): One subject played beats in synchrony with one finger from each hand. Task type (III): One subject played beats with one finger ('finger tapping'). Finger tapping of single subjects is well-studied in literature [Repp B H, Su Y H (2013), Sensorimotor synchronization: A review of recent research, (2006-2012). Psychon B Rev 20:403-452.] and serves as a baseline, whereas our focus is on synchronization between subjects. In addition to periodic tapping, a 4/4 rhythm {1, 2.5, 3, 4}, where the second beat is replaced by an offbeat, was used in tasks (I-III).

Figure 4:
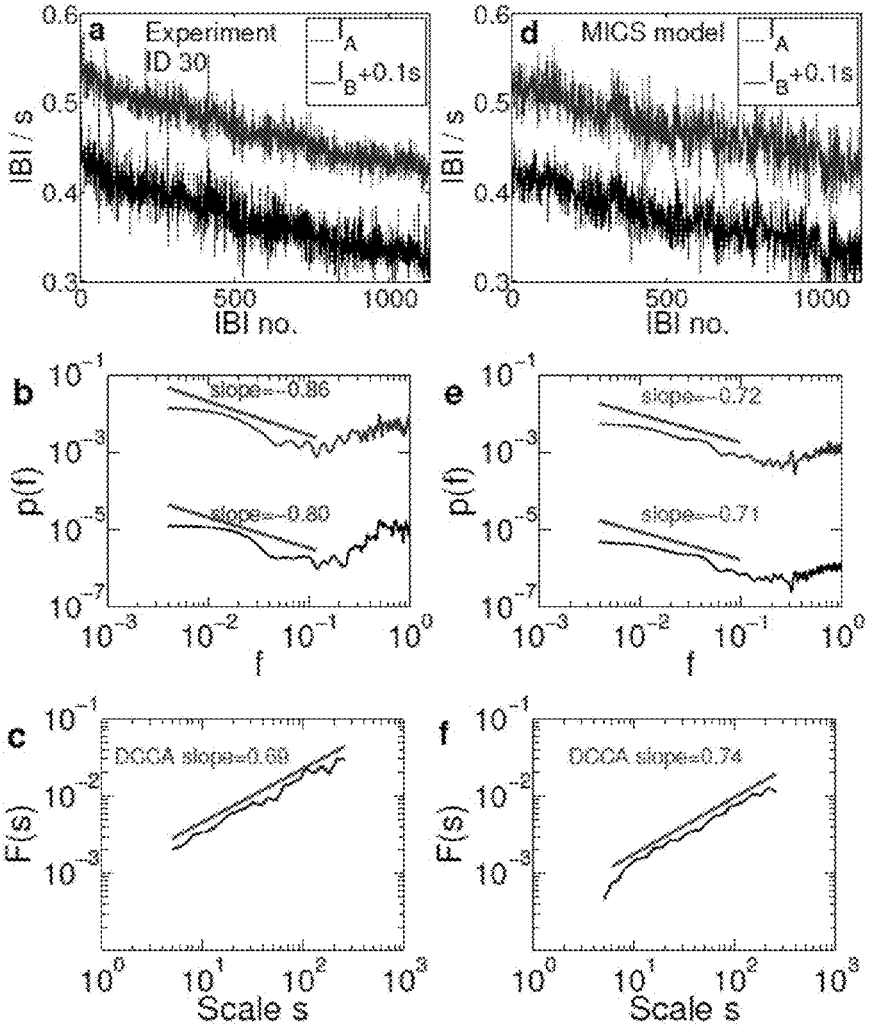
FIG. 4 shows a representative example of the findings from a recording of two professional musicians A and B playing periodic beats in synchrony (task type (Ia).

FIG. 4 shows a representative example of the findings from a recording of two professional musicians A and B playing periodic beats in synchrony (task type (Ia). FIG. 4: (top) Two professional musicians A and B synchronizing their beats: comparison of experiments (a-c) with MICS model (d-f). (a) The IBIs of 1134 beats of A (black curve) and B (blue curve, offset by 0:1 s for clarity) exhibits slowly varying trends and a tempo increase from 133 to 182 beats per minute. (b,e) The PSD of time series $I_A$, $I_B$ shows LRC asymptotically for small f and anti-correlations for large f separated by a vertex of the curve at $f \approx 0.1\ f_{Nyquist}$ [7]. (c) Evidence of LRCC between $I_A$ and $I_B$, DCCA exponent is $\delta=0.69$. (d-f) The MICS model for $\beta_A=\beta_B=0.85$, N=1133 predicts $\delta=0.74$, in excellent agreement with the experimental data. A global trend extracted from (a) was added to the curves in (d) for illustration.

A comparison of the MICS model (FIG. 4, right panel) with the experiments (left panel) shows excellent agreement. The vertex at the characteristic frequency $f_c$ in the PSD is reproduced by the MICS model (cf. FIG. 4 (*b,e*)).

The MICS model predicts emergence of LRCC (FIG. 5(*a*)). This MICS model also predicts that, asymptotically, the DFA scaling exponents $\alpha_{A,B}$ of the interbeat intervals are determined by the 'clock' with the strongest persistence: $\alpha_A=\alpha_B=[\max(\beta_A, \beta_B)+1]/2$. This result is valid for long time series of length $N \geq 105$, see FIG. 5(*b*). Surprisingly, even when turning off, say, clock A (i.e., $\beta_A=0$), the long-time behavior of both $I_A$ and $I_B$ is asymptotically given by the exponent of the long-range correlated clock B (and vice versa) for large N. Thus, the musician with the higher scaling exponent determines the partner's long-term memory in the IBIs. However, in experiments the exponents can differ significantly in shorter time series of length $N \approx 1000$ which can be seen by comparing the PSD exponents in FIGS. 4(*e*) and 5(*b*).

FIG. 5 shows: (a) Evidence of scale-free cross-correlations in the MICS model (b) The PSD of IA (and IB) shows two regions: LRC asymptotically for small f with exponent $\beta(I_A)=0.86 \approx \max(\beta_A; \beta_B)$ and anti-correlations for large f. Other parameters (a-b): $N=2^{17}$, $\beta_A=\beta_B=0.85$, coupling $W_A=W_B=0.5$, and $\sigma_A=\sigma_B=6$.

Evidence for LRCC between $I_A$ and $I_B$ on time scales up to the total recording time is reported in FIG. 4(*c*) with DCCA exponent $\delta=0.69 \pm 0.05$. The two subjects are rhythmically bound together on a time scale up to several minutes and the generation of the next beat of one subject depends on all previous beat intervals of both subjects in a scale-free manner. LRCC were found in all performances of both laypeople and professionals, when two subjects were synchronizing simple rhythms. Thus, rhythmic interaction can be seen as a scale-free process.

In contrast, when a single subject is synchronizing his left and right hands (tasks (II)), no significant LRCC were observed, suggesting that the interaction of two complex systems is a necessary prerequisite for rhythmic binding.

The inventor identified two distinct regions in the PSD of the interbeat intervals separated by a vertex of the curve at a characteristic frequency $f_c \approx 0.1\ f_{Nyquist}$ (see FIG. 4(*b*): (i) The small frequency region asymptotically exhibits long-range correlations. This region covers long periods of time up to the total recording time. (ii) The high frequency region exhibits short-range anti-correlations. This region translates to short time scales. These two regions were first described in single subjects finger tapping without a metronome [Gilden D L, Thornton T, Mallon M W (1995), 1/f noise in human cognition, Science 267:1837-1839]. Because these two regions are observed in the entire data set (i.e., in all 57 recorded time series across all tasks), this suggests that these regions are persistent when musicians interact.

FIG. 4(*e*) shows that the MICS model reproduces both regions and $f_c$ for interacting complex systems. The two subjects potentially perceive the deviations $d_n=t_{A,n}-t_{B,n}$ between their beats. The DFA exponent $\alpha=0.72$ for the time series $d_n$ indicates long-range correlations in the deviations (averaging over the entire data set one finds $\bar{\alpha}=0.73 \pm 0.11$).

In the present data set, exponents where found to be in a broad range $0.5<\lambda<1.5$, hence the analysis suggests to couple audio tracks using LRCC with a power law exponent $0.5<\lambda<1.5$. However, even larger exponents $\lambda>1.5$ are found when no global detrending of the interbeat intervals is used or in cases when the nonstationarity of the time series is not easily removed by global detrending.

There is a fundamental difference between settings where individuals are provided with a metronome click (e.g., over headphones) while playing and where no metronome is present (also referred to as self-paced play) that manifests in the PSD of the interbeat intervals.

FIG. 6 is an illustration of the PSD of the interbeat intervals when humans are playing or synchronizing rhythms (a) without and (b) with a metronome. (a) Illustration of the case where rhythms are played in absence of a metronome: The PSD of the interbeat intervals exhibits long-range correlations (asymptotically for low frequencies with PSD exponent $\beta=1.01$) and anti-correlations for high frequencies. The characteristic frequency separating the two regions is observed at $0.1\ f_{Nyquist}$. The time series of interbeat intervals was calculated with the Gilden model for $\beta=1.0$ and relative strength of clock noise over motor noise $\sigma=0.5$, i.e. for rather dominant motor noise (which only manifests on short time scales, but does not affect the long-term behavior) [Gilden D L, Thornton T, Mallon M W (1995), 1/f noise in human cognition, Science 267:1837-1839]. (b) Illustration of the case where rhythms are played while synchronizing beats with a metronome: The PSD of the interbeat intervals exhibits long-range anti-correlations.

For self-paced play of musical rhythms, the PSD of the interbeat intervals exhibits two distinct regions [Hennig H, et al. (2011), The Nature and Perception of Fluctuations in Human Musical Rhythms, PLoS ONE 6:e26457]. Long-range correlations are found asymptotically for small frequencies in the PSD. This region relates to correlations over long time scales of up to several minutes (as long as the subject does not frequently lose rhythm). On the other hand, for high frequencies in the PSD anti-correlations are found.

In contrast, a different situation is observed in presence of a metronome: For play of both complex musical rhythms [Hennig H, Fleischmann R, Geisel T (2012), Musical rhythms: The science of being slightly off, Physics Today 65:64-65.] and finger tapping [Repp B H, Su Y H (2013), Sensorimotor synchronization: A review of recent research, (2006-2012). Psychon B Rev 20:403-452.], long-range correlations were found in the time series of deviations of the beats from the metronome clicks. Below, the difference between the deviations and the interbeat intervals in the PSD will be quantified. The deviations from the metronome clicks are defined as $e_n=t_n-M_n$, where $t_n$ is the temporal occurrence (e.g., the onset) of the n'th beat, $M_n=nT$ is the temporal occurrence of the n'th metronome click and T is the time period between two consecutive metronome clicks. The interbeat intervals read $$I_n=t_n-t_{n-1}=e_n-e_{n-1}+T.$$

Hence, the interbeat intervals are the derivative of the deviations (except for a constant). In the following, a relation is derived between the PSD exponents of $e_n$ and $I_n$. Given a time series $x_n$ where the PSD asymptotically decays in a power law $1/f^{\beta}$ with exponent $\beta$. Let the time series $\dot{x}_n=x_n-x_{n-1}$ denote the derivative of $x_n$. Then it can be shown analytically that the PSD of the derivative time series $\dot{x}_n$ asymptotically follows a power law with exponent $\beta-2$ [Beran, J, Statistics for long-memory processes, Chapman&Hall/CRC 1994]. Applying this general result to the present case, one finds $$\beta(I_n)=\beta(e_n)-2$$

As a consequence, when $e_n$ exhibits long-range correlations with exponent $0<\beta(e_n))<2$, the derivative $I_n$ exhibits long-range anti-correlations with $-2<\beta(I_n)<0$.

When subjects are synchronizing beats with a metronome, the time series of deviations exhibits long-range correlations with PSD exponents reported in the range $\beta(e_n)=[0.2; 1.3]$ [Hennig H, Fleischmann R, Geisel T (2012), Musical rhythms: The science of being slightly off, Physics Today 65:64-65.]. Hence, one may expect the PSD exponents for the time series of interbeat intervals in the range $\beta(I_n)=\beta(e_n)-2=[-1.8; -0.7]$. Thus, the interbeat intervals are long-range anti-correlated for settings where a metronome is present. Humanizing a time series of deviations $e_n$ with an exponent $0<\beta<2$ thus is equivalent to humanizing the interbeat $I_n$ intervals with $-2<\beta<0$. In contrast, for self-paced play as found by the inventor (i.e., in absence of a metronome), the interbeat intervals are long-range correlated on time scales of up to several minutes.

FIG. 7 shows a user interface 700 of a software implemented human interaction device based on the MICS model. The human interaction device is a software module or plug-in that may be plugged in to a digital audio work station, comprising a computer, a sound card or audio interface, an input device or digital audio editor. For example, a user-friendly device can be created for Ableton's audio software "Live" using the application programming interface "Max for Live".

Different audio tracks are represented as channels 1 and 2. For each channel the standard deviation of the timing error may be set. In addition, the timing error for the spectrum of each channel may be set ($\beta$). Further, the motor error standard deviation may also be adjusted for each channel. Finally, the user may also set the coupling strength W for each channel. Given these data, the software device calculates an offset. More than two channels can be modified by having each additional channel responding to the average of all other channels' deviations.

Once the relevant parameters are set, the plug-in combines the audio tracks according to the previously described method.

I claim:

1. A method for combining a first audio track and a second audio track, comprising the steps modifying interbeat intervals of at least one of the two audio tracks; and storing the first audio track and the second audio track in a non-volatile medium;

characterized in that the interbeat intervals of one audio track are modified based on an average of more than one other audio track's deviations.

2. The method according to claim 1, wherein the detrended covariance of the interbeat intervals of the first audio track and the second audio track exhibits a power law.

3. The method according to claim 1, wherein small deviations are added to the interbeat intervals of at least one of the two audio tracks.

4. The method according to claim 2, wherein small deviations are added to the interbeat intervals of at least one of the two audio tracks.

5. The method according to claim 2, wherein the detrended cross-correlation exponent ($\delta$) is chosen such that $0.5<\delta<1.5$.

6. The method according to claim 1, wherein the first audio track and the second audio track are recorded sequentially.

7. The method according to claim 1, wherein one of the first audio track and the second audio track is a recording of a software instrument.

8. The method of claim 1, wherein at least one of the first audio track and the second audio track is a recording of a human musician.

9. The method of claim 1, wherein one of the audio tracks is a drum track.

10. A device for combining a first audio track and a second audio track, adapted to execute a method according to claim 1.

* * * * *